US007141126B2

(12) United States Patent
Kuniyoshi et al.

(10) Patent No.: US 7,141,126 B2
(45) Date of Patent: Nov. 28, 2006

(54) RARE EARTH MAGNET AND METHOD FOR MANUFACTURING THE SAME

(75) Inventors: Futoshi Kuniyoshi, Osaka (JP); Hitoshi Morimoto, Hyogo (JP)

(73) Assignee: Neomax Co., Ltd. (JP)

( * ) Notice: Subject to any disclaimer, the term of this patent is extended or adjusted under 35 U.S.C. 154(b) by 82 days.

(21) Appl. No.: 10/872,831

(22) Filed: Jun. 22, 2004

(65) Prior Publication Data

US 2004/0231751 A1 Nov. 25, 2004

Related U.S. Application Data

(63) Continuation of application No. 09/955,306, filed on Sep. 19, 2001, now abandoned.

(30) Foreign Application Priority Data

Sep. 19, 2000 (JP) ..... 2000-283680

(51) Int. Cl.
*H01F 1/057* (2006.01)
*H01F 1/08* (2006.01)

(52) U.S. Cl. ..... 148/122; 148/101; 148/104; 419/12; 419/30; 419/33; 419/38

(58) Field of Classification Search ..... None
See application file for complete search history.

(56) References Cited

U.S. PATENT DOCUMENTS

| | | | | |
|---|---|---|---|---|
| 5,489,343 | A | 2/1996 | Uchida et al. | |
| 5,645,651 | A | 7/1997 | Fujimura et al. | |
| 5,788,782 | A | 8/1998 | Kaneko et al. | |
| 5,858,123 | A | 1/1999 | Uchida et al. | |
| 5,968,289 | A | 10/1999 | Sakurada et al. | |
| 6,296,720 | B1 | 10/2001 | Yamamoto et al. | |
| 6,468,365 | B1 * | 10/2002 | Uchida et al. | 148/302 |
| 6,482,353 | B1 * | 11/2002 | Kuniyoshi et al. | 419/38 |
| 6,511,631 | B1 | 1/2003 | Kuniyoshi et al. | |
| 6,529,107 | B1 | 3/2003 | Shimuzu et al. | |

FOREIGN PATENT DOCUMENTS

| | | |
|---|---|---|
| EP | 0 753 867 A1 | 1/1997 |
| EP | 0 994 493 A2 | 4/2000 |
| JP | 62-170455 | 7/1987 |
| JP | 63-033505 | 2/1988 |
| JP | 63-301505 | 12/1988 |
| JP | 07-018366 | 1/1995 |

(Continued)

OTHER PUBLICATIONS

European Search Report (Dated Jul. 24, 2003).

(Continued)

*Primary Examiner*—John P. Sheehan
(74) *Attorney, Agent, or Firm*—Nixon Peabody LLP; Jeffrey L. Costellia

(57) ABSTRACT

Rare earth alloy powder having an oxygen content of 50 to 4000 wt. ppm and a nitrogen content of 150 to 1500 wt. ppm is compacted by dry pressing to produce a compact. The compact is impregnated with an oil agent and then sintered. The sintering process includes a first step of retaining the compact at a temperature of 700° C. to less than 1000° C. for a period of time of 10 to 420 minutes and a second step of permitting proceeding of sintering at a temperature of 1000° C. to 1200° C. The average crystal grain size of the rare earth magnet after the sintering is controlled to be 3 μm to 9 μm.

9 Claims, 2 Drawing Sheets

FOREIGN PATENT DOCUMENTS

| | | |
|---|---|---|
| JP | 08-069908 | 3/1996 |
| JP | 08-279406 | 10/1996 |
| JP | 10-012473 | 1/1998 |
| JP | 10-041174 | 2/1998 |
| JP | 10-321451 | 12/1998 |
| WO | WO 93/20567 | 10/1993 |

OTHER PUBLICATIONS

Notice of Reasons of Rejection, Patent Application No. 2001-272116, Mailing Date: Dec. 25, 2001, Mailing No. 593114.

Mikio et al., English language translation of Japanese Patent Document No. 08-279406, Oct. 22, 1996, Original Japanese document cited in applicants' IDS submitted Mar. 15, 2002.

* cited by examiner

RARE EARTH MAGNET AND METHOD FOR MANUFACTURING THE SAME

CROSS-REFERENCE TO RELATED APPLICATIONS

This patent application is continuation of U.S. patent application Ser. No. 09/955,306, tiled Sep. 19, 2001, now abandoned.

BACKGROUND OF THE INVENTION

1. Field of the Invention

The present invention relates to a rare earth magnet and a method for manufacturing the same. More particularly, the present invention relates to a high-performance rare earth sintered magnet manufactured of rare earth alloy powder having a reduced oxygen content.

2. Description of the Related Art

An R—Fe—B rare earth magnet (R is at least one kind of element selected from the group consisting of yttrium (Y) and rare earth elements) is mainly composed of a major phase made of an $R_2Fe_{14}B$ tetragonal compound, an R-rich phase including a rare earth element such as Nd in a large proportion, and a B-rich phase including boron (B) in a large proportion. The magnetic properties of an R—Fe—B rare earth magnet are improved by increasing the proportion of an $R_2Fe_{14}B$ tetragonal compound as the major phase in the magnet.

At least a minimum amount of the R-rich phase is necessary for liquid-phase sintering which is a necessary process for forming sintered rare earth magnets. Since R reacts with oxygen to generate an oxide $R_2O_3$, R is partly consumed prior to the sintering. Therefore, to compensate for the amount consumed by the oxidation, an additional amount of R is conventionally required. The oxide $R_2O_3$ is generated more vigorously as the amount of oxygen is greater. In view of this, it has been attempted to reduce the concentration of oxygen in an atmosphere in which R—Fe—B alloy powder is produced to suppress generation of the oxide $R_2O_3$, and to thereby reduce the relative amount of the R in the finally manufactured R—Fe—B rare earth magnet and thus improve the magnetic properties of the magnet.

The amount of oxygen in R—Fe—B alloy powder used for manufacture of an R—Fe—B magnet should preferably be small, as described above. However, no attempt to reduce the amount of oxygen in R—Fe—B alloy powder for improving the magnet properties has been realized as a mass production technique, for the following reason. If R—Fe—B alloy powder is produced in a controlled environment of a low oxygen concentration so that the amount of oxygen in the alloy powder is as low as 4000 wt. ppm or less, for example, the powder may vigorously react with oxygen in the atmosphere (the air), causing the possibility of ignition in several minutes at room temperature.

Hydrogen processing for milling provides good production efficiency compared with mechanical milling using a ball mill, for example. However, when magnet powder produced by the hydrogen processing is used for manufacture of a magnet, the resultant magnet tends to vary in magnetic properties (coercive force among others) depending on the sintering conditions. In particular, the variation in magnetic properties is significant when the amount of oxygen in the sintered body is as small as 4000 wt. ppm or less and the total amount of the rare earth element in the magnet is comparatively small (e.g., 32 wt. % or less).

Therefore, while it has been recognized that the amount of oxygen in R—Fe—B alloy powder should desirably be reduced for improving the magnetic properties, in reality, it is extremely difficult to handle R—Fe—B alloy powder having a reduced oxygen concentration in a production site such as a plant.

In particular, the risk of ignition is high during a pressing or compacting process in which powder is compacted with a press. In this process, the temperature of a compact rises due to heat generated as the result of friction among powder particles during compaction and as a result of friction between powder particles and the inner sidewall of a cavity of the press during ejection of the compact. One possible technique for prevention of ignition includes placement of the press in an environment of a non-oxygen atmosphere. This placement is however impractical because supply of the raw material to the press and retrieval of the compact from the press are difficult in such a non-oxygen environment. The occurrence of ignition may also be avoided if individual compacts are immediately sintered when they are ejected from the press. This is, however, an extremely inefficient process, and thus not suitable for mass production. A sintering process takes four hours or more, and it is reasonable that each sintering process is carried out against a lot of compacts at the same time. In addition, in mass production facilities, it is difficult to manage compacts in an environment of an extremely low oxygen concentration through a series of processing steps from pressing to sintering.

A liquid lubricant such as fatty ester is often added to fine powder before the pressing process to improve compressibility or formability of the powder. By this addition of a liquid lubricant, thin oily coatings are formed on the surfaces of powder particles. Such coatings however fail to sufficiently prevent oxidation of the powder having an oxygen concentration of 4000 wt. ppm or less.

For the above reasons, a slight amount of oxygen is intentionally introduced into an atmosphere in which an R—Fe—B alloy is milled, to thereby oxidize thin surfaces of finely milled powder particles and thus reduce the reactivity of the powder. In an example of such a technique, Japanese Patent Publication No. 6-6728 discloses a process in which a rare earth alloy is finely milled under a supersonic inert gas flow containing a predetermined amount of oxygen, so that during the milling a thin oxide coating is formed on the surfaces of fine powder particles produced by the milling. According to this technique, since oxygen in the atmosphere is blocked by the oxide coatings on the powder particles, occurrence of heat generation/ignition due to oxidation is prevented. Note, however, that with the existence of the oxide coatings on the surfaces of the powder particles, the amount of oxygen contained in the powder increases.

U.S. Pat. No. 5,489,343 and Japanese Laid-Open Patent Publication No. 10-321451 disclose another technique where R—Fe—B alloy powder having a low oxygen content (for example, 1500 ppm) is mixed with mineral oil or the like to obtain slurry. Since powder particles in the slurry are kept from contact with the atmosphere, occurrence of heat generation/ignition is prevented while the oxygen content of the R—Fe—B alloy powder is kept low.

This conventional technique has the problem that after the R—Fe—B alloy powder in the slurry state is filled in a cavity of a press, the oil must be squeezed out during the pressing process. This reduces productivity. Further, conventional methods for manufacturing a rare earth magnet have the problem that crystal grains tend to become coarse during sintering. The magnet properties (coercive force)

therefore fail to be improved sufficiently even when magnet powder having a low oxygen concentration is used.

SUMMARY OF THE INVENTION

A main object of the present invention is providing a high-performance rare earth magnet having a low oxygen content and excellent magnet properties, and a method for manufacturing such a rare earth magnet.

The method for manufacturing an R—Fe—B rare earth magnet of the present invention includes the steps of: preparing rare earth alloy powder having an oxygen content in a range of 50 wt. ppm to 4000 wt. ppm and a nitrogen content in a range of 150 wt. ppm to 1500 wt. ppm; compacting the rare earth alloy powder by dry pressing to produce a compact; impregnating the compact with an oil agent from the surface of the compact; and sintering the compact. The oil agent preferably includes a volatile component such as a hydrocarbon solvent; while, the step of sintering the compact includes:

a first step of retaining the compact at a temperature in a range of 700° C. to less than 1000° C. for a period of time in a range of 10 minutes to 420 minutes; and a second step of continuing the sintering at a temperature in a range of 1000° C. to 1200° C., and the average crystal grain size of $R_2Fe_{14}B$ compounds in the rare earth magnet after the sintering is in a range of 3 μm to 9 μm. The average crystal grain size of the $R_2Fe_{14}B$ compounds in the rare earth magnet after the sintering is more preferably in a range of 3 μm to 6 μm.

Preferably, the method further includes the step of removing the oil agent substantially prior to the step of sintering the compact, and after the step of removing the oil agent, the compact is kept away from contact with the atmosphere until termination of the step of sintering the compact.

In a preferred embodiment, the step of preparing rare earth alloy powder includes milling a material alloy in a nitrogen gas atmosphere having an oxygen concentration of 5000 wt. ppm or less and nitriding the surface of milled powder. The oxygen concentration of the nitrogen gas atmosphere is more preferably 2000 wt. ppm or less, and the average particle size (mass median particle diameter) of the rare earth alloy powder is preferably in a range of 1.5 μm to 5.5 μm.

In still another preferred embodiment, after the step of impregnating the compact, the temperature of the compact is at least temporarily reduced due to volatilization of the oil agent. Additionally, prior to the step of compacting the rare earth alloy powder, a lubricant is preferably added to the rare earth alloy powder.

The R—Fe—B rare earth magnet of the present invention has an average crystal grain size in a range of 3 μm to 9 μm, an oxygen concentration in a range of 50 wt. ppm to 4000 wt. ppm, and a nitrogen concentration in a range of 150 wt. ppm to 1500 wt ppm.

Alternatively, the method for manufacturing an R—Fe—B rare earth magnet of the present invention includes the steps of: preparing rare earth alloy powder having an oxygen content in a range of 50 wt. ppm to 4000 wt. ppm and a nitrogen content in a range of 150 wt. ppm to 1500 wt. ppm by embrittling an R—Fe—B rare earth alloy by hydrogen occlusion and milling the embrittled alloy; compacting the rare earth alloy powder to produce a compact; retaining the compact at a temperature in a range of 700° C. to less than 1000° C. for a period of time in a range of 10 minutes to 420 minutes and releasing hydrogen outside the compact so that the amount of hydrogen contained in the finally-manufactured magnet is in a range of 10 wt. ppm to 100 wt. ppm; and sintering the compact at a temperature in a range of 1000° C. to 1200° C. The rare earth magnet after the sintering has an average crystal grain size in a range of 3 μm to 13 μm.

In another alternative, the R—Fe—B rare earth magnet of the present invention has an oxygen concentration in a range of 50 wt. ppm to 4000 wt. ppm, a nitrogen concentration in a range of 150 wt. ppm to 1500 wt. ppm, and a hydrogen content in a range of 10 wt. ppm to 100 wt. ppm.

In a preferred embodiment, a rare earth element concentration is 32 wt. % or less of the magnet.

The average crystal grain size is preferably in a range of 3 μm to 13 μμm.

The R—Fe—B rare earth magnet is preferably manufactured using an alloy produced by quenching.

The R—Fe—B rare earth magnet of the present invention has an oxygen concentration in a range of 50 wt. ppm to 4000 wt. ppm, and a hydrogen content in a range of 10 wt. ppm to 100 wt. ppm, wherein a rare earth element concentration is 32 wt. % or less of the magnet.

DETAILED DESCRIPTION OF THE INVENTION

Figure 1:
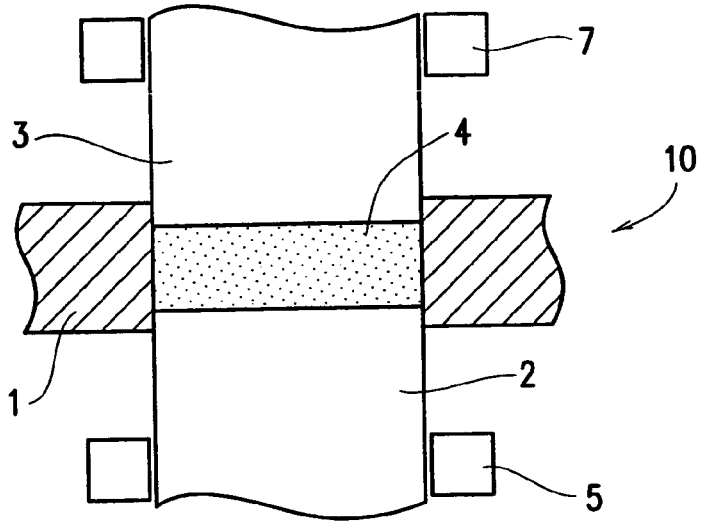
FIG. 1 is a schematic cross-sectional view of a press used for compaction of magnetic powder.

According to the present invention, for reducing the oxygen content of an R—Fe—B rare earth magnet, the concentration of oxygen in rare earth magnet powder is reduced, and the reactive surfaces of the magnet powder particles are intentionally nitrided to form a thin protection film covering the surface of the magnet powder particles. This addition of nitrogen contributes to suppressing oxidation of the magnet powder when contact with the atmosphere.

Further, according to the present invention, sintering is performed in two stages using a relatively low temperature and a relatively high temperature. By this two-stage sintering, grain growth during sintering is suppressed, enabling reduction in the average crystal grain size of the finally-manufactured sintered magnet.

When it is attempted to mass-produce a sintered magnet using magnet powder having a low oxygen concentration, a compact of the magnet powder conventionally tends to cause heat generation/ignition as described previously. This poses a significant disadvantage to the mass-production of a sintered magnet. According to the present invention, in order to solve the problem of heat generation/ignition of a compact, the surface of magnet powder particles, having a low oxygen concentration, are nitrided thus weakening the reactivity of the surface of the particles. In addition, the resultant powder compact is impregnated with an organic solvent. An organic solvent contains carbon and other impurities that are considered improper for rare earth sintered magnets. However, these impurities are removed sufficiently through a preheating (oil removing) process prior to sintering and are thus prevented from adversely influencing the final magnet properties.

As a result, it is considered that the particle surfaces are not only suppressed from reacting with oxygen in the atmosphere, but also suppressed from reacting or binding with the organic solvent. Thus, carbon and other impurities contained in the organic solvent can be immediately volatilized/removed from the compact before sintering. Therefore, deterioration in magnet properties due to the organic solvent is reliably avoided.

An R—Fe—B rare earth magnet of an embodiment of the invention has an average crystal grain size in the range of 3 μm to 9 μm, an oxygen concentration in the range of 50 wt. ppm to 4000 wt. ppm, and a nitrogen concentration in the range of 150 wt. ppm to 1500 wt. ppm. The "R—Fe—B rare earth magnet" as used herein is defined to broadly include a rare earth magnet with a metal such as cobalt (Co) substituting for part of Fe and a rare earth magnet with carbon (C) substituting for part of boron (B). The R—Fe—B rare earth magnet has a structure in which $R_2Fe_{14}B$ compounds of tetragonal crystals exist as a major phase. The $R_2Fe_{14}B$ crystals are surrounded by an R-rich and B-rich phase (boundary phase) in the R—Fe—B rare earth magnet. The structure of such an R—Fe—B rare earth magnet is disclosed in U.S. Pat. No. 5,645,651, which is incorporated herein by reference.

Hereinafter, a preferred embodiment of the method for manufacturing such a rare earth magnet will be described in detail.

Initially produced is molten mass of an R—Fe—B alloy containing about 10 to about 30 at. % of R (at least one kind from the group consisting of Y and the rare earth elements), 0.5 to 28 at. % of B, and Fe as the remainder, together with inevitably contained impurities. Either one or both of Co and Ni may be substituted for part of Fe, and C may be substituted for part of B. According to the present invention, the oxygen content can be reduced and thus production of an oxide of the rare earth element R can be suppressed. It is therefore possible to keep the amount of the rare earth element R to its necessary minimum amount.

The molten alloy is then quenched and solidified into a shape of thin plates having a thickness of 0.03 to 10 mm at a cooling rate of $10^2$ to $10^{4\circ}$ C./sec by a quenching method such as strip casting, to form cast pieces having a structure with the R-rich phase having a fine size of 5 μm or less being dispersed. The cast pieces, accommodated in a case, are placed in a chamber provided with air intake and outlet facilities. After evacuation of the chamber, $H_2$ gas with a pressure of 0.03 to 1.0 MPa (megapascal) is supplied into the chamber, to form disintegrated alloy powder. The disintegrated alloy powder is dehydrogenated and then finely milled under inert gas flow.

The cast pieces as a magnet material used in the present invention can be produced appropriately by quenching the molten alloy of a specific composition by strip casting using a single roll method or a twin roll method. The use of the single roll method or the twin roll method may be determined depending on the thickness of the cast pieces to be produced. The twin roll method is preferably used when thick cast pieces are to be produced, while the single roll method is preferably used when thin cast pieces are to be produced. An alloy produced by a quenching method exhibits a sharp particle size distribution, is uniform in particle size, and thus improves in the squareness of a demagnetization curve after sintering.

If the thickness of the cast pieces (flake-like alloy) is less than 0.03 mm, the quenching rate is so great that the crystal grain size may be excessively small. If the crystal grain size is excessively small, when the cast pieces are powdered the powder particles individually have a polycrystalline structure. This results in failure to align the crystal orientation and thus degradation of the magnetic properties. If the thickness of the cast pieces exceeds 10 mm, the cooling rate is low. As a result, α-Fe is easily precipitates, and also the Nd-rich phase is unevenly distributed.

The hydrogen processing for embrittlement is performed in the following manner, for example. The cast pieces crushed to a predetermined size are put in a material case, and the material case is placed in a sealable hydrogen furnace, which is then sealed. After sufficient evacuation of the hydrogen furnace, hydrogen gas with a pressure of 30 kPa to 1.0 MPa is supplied into the furnace, to allow the cast pieces to occlude hydrogen. Since the hydrogen occlusion is exothermic reaction, cooling piping for flowing cooling water is preferably provided around the furnace to prevent temperature rise in the furnace. The cast pieces spontaneously disintegrate due to the hydrogen occlusion and thus are embrittled (or partially powdered).

The embrittled alloy is cooled and dehydrogenated by heating under vacuum. The dehydrogenated alloy powder particles have microcracks. Such particles can be finely milled in a short time during subsequent milling with a ball mill, a jet mill, or the like. Thus, alloy powder with a predetermined particle size distribution can be produced. A preferred embodiment of the hydrogen processing for milling is disclosed in Japanese Laid-Open Patent Publication No. 7-18366.

The above fine milling is preferably performed with a dry mill such as a jet mill, an attritor, and a vibration mill, using inert gas containing nitrogen and containing substantially no oxygen. During this milling, the oxygen concentration of the inert gas is preferably controlled at 5000 ppm or less, and a high-purity nitrogen gas having a purity of 99.99% or more is desirably used as the inert gas. By milling the powdered alloy in an atmosphere of such a high-purity nitrogen gas, it is possible to produce finely milled powder having a low oxygen concentration of which the particle surfaces have been thinly nitrided. The average particle size (milled particle size) of the powder is preferably in the range of 1.5 μm to 5.5 μm, more preferably in the range of 2.5 μm to 5.0 μm.

It is preferable to add to the thus-produced magnet powder a liquid lubricant containing fatty ester and the like as a major ingredient. The added amount is 0.15 to 5.0 wt. %, for example. Examples of the fatty ester include methyl caproate, methyl caprylate, and methyl laurate. The lubricant may also contain an ingredient of a binder and the like. Important is that the lubricant should volatilize and be removed in a subsequent process. If the lubricant itself is a solid that is not easily mixed with the alloy powder uniformly, the lubricant may be diluted with a solvent. As such a solvent, a petroleum solvent represented by isoparaffin, a naphthenic solvent, and the like may be used. The lubricant may be added at an arbitrary time, which may be before, during, or after the milling. The liquid lubricant provides the effect of protecting the powder particles from being oxidized by covering the surfaces of the particles. In addition, the liquid lubricant provides the function of making the green density of a compact uniform during pressing of the powder and thus suppressing disorder of alignment.

Next, alignment in a magnetic field (magnetic alignment) and compaction are performed with a press as shown in FIG. 1. A press 10 in FIG. 1 includes a die 1 having a through-hole and punches 2 and 3 for blocking the through-hole of the die 1 from below and above. Material powder 4 is filled in a cavity defined by the die 1, the upper punch 3, and the lower punch 2, and compacted by reducing the gap between the lower punch 2 and the upper punch 3 (pressing process). The press 10 in FIG. 1 also includes coils 5 and 7 for generating an aligning magnetic filed.

The filling density of the powder 4 is set to fall within a range in which magnetic alignment is possible for the powder. In this embodiment, the filling density is preferably in the range of 30 to 40% of the true density, for example.

After the powder filling, a magnetic field is applied to the space filled with the powder 4, to perform magnetic alignment of the powder 4. This is effective not only for parallel magnetic field compaction, where the direction of the magnetic field matches with the pressing direction, but also for vertical magnetic field compaction where the direction of the magnetic field is vertical to the pressing direction.

Figure 2:
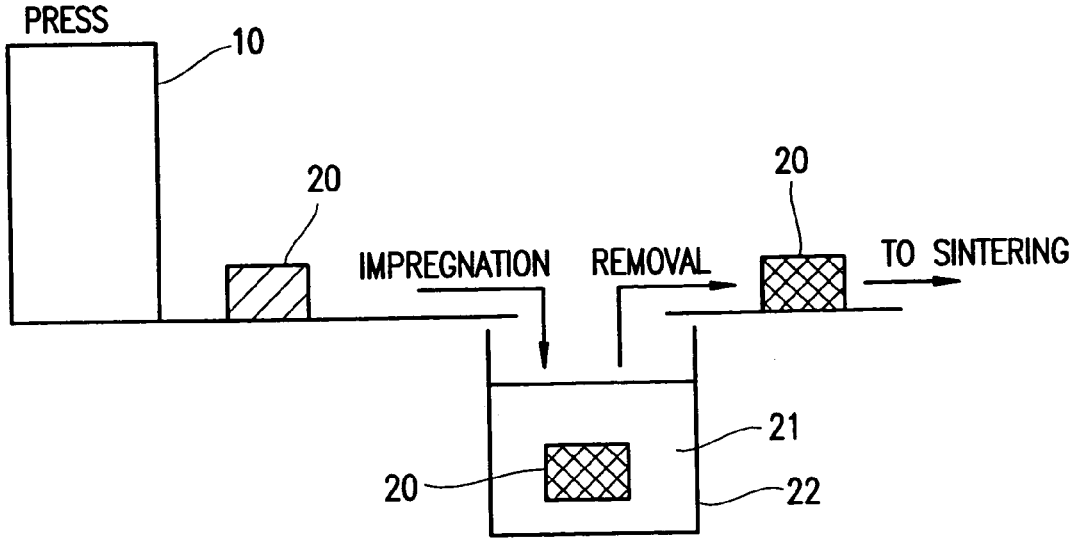
FIG. 2 is a diagram illustrating an impregnation process.

After being ejected from the press 10 in FIG. 1, the compact is immediately impregnated with an oil agent such as an organic solvent. FIG. 2 illustrates an impregnation process. In this embodiment, a solution of saturated hydrocarbon, such as isoparaffin, is used as the solvent with which a compact 20 is impregnated. An organic solvent 21 is filled in a bath 22 as shown in FIG. 2 to allow the compact 20 to be immersed in the organic solvent 21 in the bath 22. The compact 20 is impregnated or soaked with the organic solvent 21 from the surface of the compact 20 (i.e., the surface that defines the shape of the compact 20) and thus substantially covered with the solution of saturated hydrocarbon. This prevents the compact 20 from being in direct contact with oxygen in the atmosphere. Therefore, the possibility of heat generation/ignition of the compact 20 in a short time is greatly reduced even when the compact 20 is left in the atmosphere. A half second or longer is enough as the duration of the compact 20 being immersed or soaked in the organic solvent 21 (immersing time). As the immersing time is longer, the amount of the organic solvent contained in the compact is larger. A larger amount of the organic solvent however does not cause a problem such as collapse of the compact. Therefore, the compact may be kept immersed in the organic solvent, or the impregnation process may be repeated a plurality of times, until the sintering process starts.

As the organic solvent used for the impregnation, it is possible to use a solvent such as the liquid lubricant added to the powder for improving the formability and the degree of alignment, and the organic solvent used for diluting the liquid lubricant. The organic solvent is required to have a function of preventing surface oxidation. In consideration of this, particularly preferred as the organic solvent are petroleum solvents represented by isoparaffin, naphthenic solvents, fatty esters such as methyl caproate, methyl caprylate, and methyl laurate, higher alcohols, higher fatty acids, and the like.

After the impregnation, the compact 20 is subjected to known manufacturing processes including preheating (oil removing), two-stage sintering, and aging, to be finally completed as a permanent magnet product. Carbon (C) contained in the oil agent deteriorates the magnetic properties of the resultant rare earth magnet. Therefore, as the oil agent with which the compact 20 is impregnated, must be one that is easily removed from the compact during preheating and/or sintering is selected. The oil agent is therefore prevented from adversely influencing the magnet properties. After volatilization of the oil agent during preheating before sintering, the compact must be placed in an environment of a low oxygen concentration to be kept away from contact with the atmosphere. For this purpose, furnaces for preheating and sintering are preferably directly coupled with each other so that the compact can be moved between the furnaces without direct contact with the atmosphere. A continuous furnace is more desired.

According to the present invention, two-stage sintering is performed as described above. By the two-stage sintering, it is possible to control the crystal grain size of the finally-manufactured sintered magnet in the range of 3 μm to 9 μm, preferably in the range of 3 μm to 6 μm. In the conventional sintering process, crystal grains become coarse by grain growth during sintering. For this reason, it is difficult to improve the coercive force of the magnet sufficiently even when magnet powder having a low oxygen content is used. According to the sintering process adopted in the present invention, however, the effect of using the magnet powder having a low oxygen content can be sufficiently exhibited.

Figure 3:
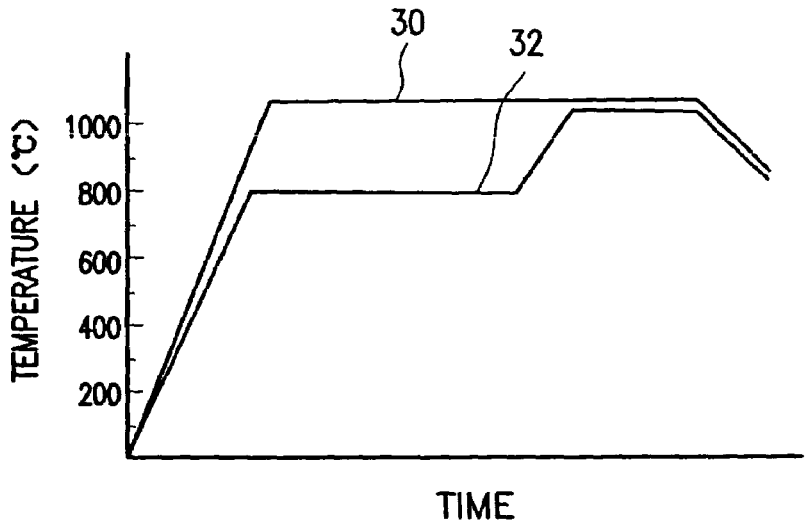
FIG. 3 shows temperature profiles in a sintering process, where 30 denotes a profile in a conventional sintering process and 32 denotes a profile in a sintering process according to the present invention.

FIG. 3 shows temperature profiles in the sintering process. In FIG. 3, the reference numeral 30 denotes a profile adopted in the conventional sintering process, while 32 denotes a profile adopted in the sintering process according to the present invention.

Two-stage heat treatment is performed in the sintering process in this embodiment. At the first stage, the compact is kept at a relatively low temperature (for example, 750 to 950° C.) for a relatively long period of time (for example, 30 to 360 minutes). The stage then proceeds to the second stage, where the compact is kept at a relatively high temperature (for example, 1000 to 1100° C.) for a relatively short period of time (for example, 30 to 240 minutes).

Hydrogen remaining in the $R_2Fe_{14}B$ phase as the major phase during the hydrogen processing for pulverization, which is the processing utilizing the phenomenon of hydrogen occlusion and embritlement of the rare earth alloy is released in the preheating process at about 500° C. performed before the sintering process. However, the temperature of about 500° C. is not high enough to dehydrogeneate a rare earth hydrogen compound ($RH_x$) formed by the combining between the rare earth element included in the R-rich phase and hydrogen during the hydrogen processing for pulverization. In the sintering process according to the present invention, such a rare earth hydrogen compound ($RH_x$) releases hydrogen to form rare earth metal at the first stage. More specifically, during the first-stage heat treatment at a temperature of 700° C. or more, there occurs reaction represented by $RH_x \rightarrow R+(x/2)H_2\uparrow$. As a result, at the second-stage heat treatment, the R-rich phase at the grain boundary is swiftly turned into a liquid phase, permitting swift proceeding of the sintering process and shrinkage of the sintered body. The sintering process is therefore completed in a short period of time, and this suppresses the crystal grains from becoming coarse. As a result, the coercive force of the sintered magnet improves, and also the density of the sintered body increases.

According to experiments carried out by the present inventors, the coercive force of a sintered magnet varies with the crystal grain size of the magnet more significantly when the oxygen content of the sintered magnet is smaller. For example, when the oxygen content was 7000 wt. ppm, the difference in coercive force was less than 10% between a magnet having a crystal grain size of about 3 to about 6 μm and a magnet having a crystal grain size of about 12 to about 15 μm. When the oxygen content was 3000 wt. ppm, the difference in coercive force was as large as about 10% or more between a magnet having an average crystal grain size of 9 μm or less and a magnet having an average crystal grain size exceeding 9 μm.

In this embodiment, the material alloy was produced by strip casting. Alternatively, other methods such as ingot casting, direct reduction, atomizing, and centrifugal casting, may be adopted.

EXAMPLE 1

A molten alloy having a composition of Nd+Pr (30.0 swt. %), Dy (1.0 wt. %), B (1.0 wt. %), and Fe (the balance) was produced in a high-frequency melting crucible. The molten alloy was then cooled with a roll-type strip caster to produce thin plate-shaped cast pieces (flake-like alloy) having a thickness of about 0.5 mm. The concentration of oxygen contained in the flake-like alloy was 150 wt. ppm.

The flake-like alloy accommodated in a case was then placed in a hydrogen furnace. After evacuation of the furnace, hydrogen gas was supplied into the furnace for two hours for hydrogen embrittlement. The hydrogen partial pressure in the furnace was set at 200 kPa. After the flakes spontaneously disintegrated due to hydrogen occlusion, the furnace was evacuated while heating, for dehydrogenation. Argon gas was then introduced into the furnace, and the furnace was cooled to room temperature. The alloy was taken out from the hydrogen furnace when the temperature of the alloy was lowered to 20° C. At this stage, the oxygen content of the alloy was 1000 wt. ppm.

The resultant alloy was milled with a jet mill having a milling chamber filled with a nitrogen gas atmosphere of which the oxygen concentration was controlled to 200 vol.ppm or less, to produce magnet powder having various oxygen concentrations. The milling conditions such as the milling time were adjusted so as to vary the average particle size (milled particle size) within the range of 1.5 to 7.5 μm, to thereby produce various types of powder having different average particle sizes. During the milling, also, the amount of oxygen contained in the nitrogen atmosphere was controlled so as to vary the oxygen content of the powder with about 7000 wt. ppm as the maximum. The thus-produced types of powder had nitrogen concentrations in the range of 100 to 900 wt. ppm.

Thereafter, 0.5 wt. % of a liquid lubricant was added to the resultant milled powder with a rocking mixer. As the lubricant, one containing methyl caproate as a major ingredient was used. Each type of powder was then compacted by dry pressing with the press shown in FIG. 1 to produce a compact. The "dry" as used herein is broadly defined as including the case where the powder contains a comparatively small amount of a lubricant (oil agent), as in this example, as long as the process of squeezing the oil agent is not necessary. The size of the compact was 30 mm×50 mm×30 mm and the density was 4.2 to 4.4 g/cm$^3$.

Each compact was then impregnated with an oil agent from the surfaces thereof. Isoparaffin was used as the oil agent. The compact was entirely immersed in the oil agent for 10 seconds. The compact was then taken out from the oil agent, and left standing in the atmosphere at room temperature. Thereafter, the temperature of the compact was measured. Heat is generated when a rare earth element in the compact is oxidized. Therefore, by measuring the temperature of the compact, the progress of oxidation can be evaluated.

The temperature of the compact was 40° C. or less immediately after the impregnation and remained below 50° C. even after the lapse of 600 seconds. The rise of the temperature of the compact was terminated after the lapse of about 2000 seconds. Even the compact produced from the powder having the lowest oxygen concentration had a maximum temperature of only about 70° C. Therefore, no possibility of ignition existed even when the compact was left standing in the atmosphere for a long period of time. There was observed a phenomenon that the temperature of the compact reduced temporarily (a few minutes) after the impregnation. This is because the oil agent volatilized from the surface of the compact and the compact was cooled due to heat of vaporization.

The case of performing no impregnation with an oil agent for a compact (comparative example) was also examined. A compact of which the oxygen concentration was adjusted to about 2000 wt. ppm or less ignited in the atmosphere about two minutes after ejection from the press. A compact of which the oxygen concentration was about 3000 wt. ppm continued temperature rise from immediately after pressing and reached as high as 90° C. before the lapse of 600 seconds, causing the risk of ignition. Heat generated by oxidation facilitates oxidation of surrounding powder. Therefore, once oxidation starts, the temperature of the compact sharply rises, and the risk of ignition significantly increases. Such a compact presumably continues being gradually oxidized and accumulates heat inside even when the compact is placed in a container filled with an atmosphere having a comparatively low oxygen concentration. Therefore, the compact will sooner or later generate heat sharply, causing the risk of ending up with ignition.

The compacts coated with the oil agent were preheated at 250° C. for two hours for oil removal, and then sintered under the conditions shown in Table 1 below. Table 1 shows the particle size of powder before sintering (milled particle size) and the average crystal grain size after sintering. The milled particle size is a median size measured with a He—Ne laser diffraction-type particle size distribution measuring apparatus (for example, HELOS & RODOS type available from Sympatec Corp.), and the average crystal grain size of the $R_2Fe_{14}B$ phase was measured according to a cutting method defined by JIS H 0501.

TABLE 1

| Sample No. | 1 | 2 | 3 | 4 |
|---|---|---|---|---|
| Milled particle size (μm) | 1.5–3.5 | 3.5–5.5 | 3.5–5.5 | 5.5–7.5 |
| Sintering Conditions | 800° C. 4 hrs. + 1050° C. 2 hrs. | 800° C. 4 hrs. + 1050° C. 2 hrs. | 1060° C. 6 hrs | 1060° C. 6 hrs. |
| Crystal grain size (μm) | 3–6 | 6–9 | 9–12 | 12–15 |

Various magnetic properties were measured for the sintered magnets manufactured under the above conditions. Table 2 below shows how the magnetic properties change depending on the oxygen concentration of powder used for compaction.

TABLE 2

| Oxygen content (wt. ppm) | Sample No. 1 Coercive force (kA/m) | 2 Coercive force (kA/m) | 3 Coercive force (kA/m) | 4 Coercive force (kA/m) |
|---|---|---|---|---|
| 1200 | 1230 | 1200 | 1080 | 900 |
| 2000 | 1200 | 1180 | 1050 | 890 |
| 2500 | 1200 | 1110 | 1000 | 850 |
| 3100 | 1130 | 1080 | 1000 | 860 |
| 4200 | 1000 | 1020 | 1000 | 840 |
| 5500 | 820 | 780 | 780 | 750 |
| 7000 | 600 | 580 | 570 | 580 |

Figure 4:
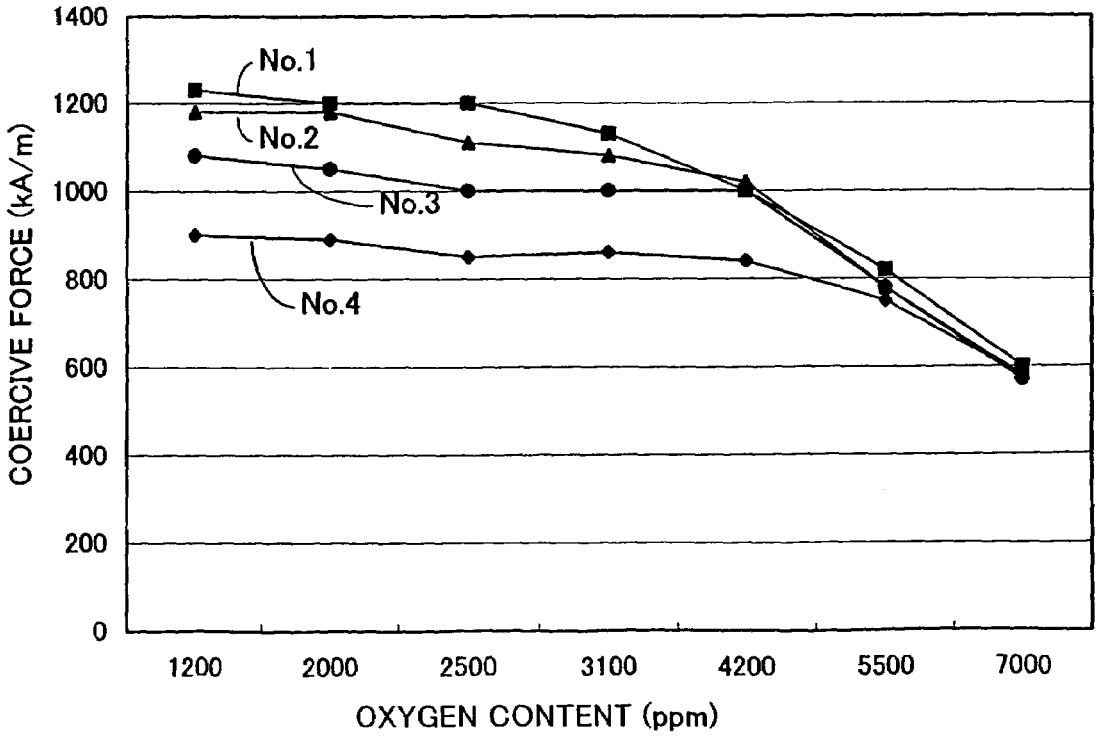
FIG. 4 is graph representation of data shown in Table 2, where the y-axis represents the coercive force and the x-axis represents the oxygen content.

FIG. 4 is a graph prepared based on the data shown in Table 2. The y-axis and the x-axis of this graph respectively represent the coercive force (kA/m) and the oxygen content (wt. ppm). The oxygen content, which indicates the concentration of oxygen contained in the magnet after the sintering, was measured by a non-dispersion infrared detection method. The nitrogen content was measured by a thermal conductivity detection method. Specifically, the oxygen content and the nitrogen content were measured with a measuring apparatus (EMGA-550) available from Horiba, Ltd.

As is apparent from Table 2 and FIG. 4, the coercive force is higher as the crystal grain size after sintering is smaller and the oxygen concentration is lower. When the oxygen concentration after the sintering process is high (for example, 7000 wt. ppm), the coercive force is low irrespective of the crystal grain size. On the contrary, when the oxygen concentration is low, the coercive force clearly depends on the crystal grain size.

It was also found that although the milled particle size was in the range of 3.5 to 5.5 μm, the crystal grains became coarse when the two-stage sintering was not performed. In this case, therefore, the effect of providing a high coercive force by reducing the oxygen concentration was not sufficiently exhibited.

In consideration of the above, the crystal grain size should preferably be made small by adopting the two-stage sintering process when, in particular, a sintered magnet is to be manufactured using magnet powder having a low oxygen concentration. For example, when the oxygen concentration of the sintered magnet is in the range of 1000 wt. ppm to 4000 wt. ppm, the average crystal grain size of the sintered magnet should preferably be in the range of 3 μm to 9 μm.

The case of performing the fine milling in an atmosphere of helium (He) and argon (Ar), for example, was also examined. In this case, the surfaces of powder particles were not nitrided. Since no nitride layers were formed on the surfaces of the powder particles, the powder was easily oxidized causing ignition during the process and deterioration of the magnetic properties. On the contrary, when the surfaces of the powder particles were nitrided excessively, the sintering process proceeded less smoothly, resulting in deterioration of the magnetic properties. In view of these, the nitrogen concentration in the magnet powder should preferably be controlled in the range of 150 wt. ppm to 1500 wt. ppm, more preferably in the range of 200 wt. ppm to 700 wt. ppm.

The method for impregnating the surface portion of a compact with an oil agent is not limited to that described above. A spraying method, a brushing method, or the like may also be adopted, and in such a case, substantially the same effect can be obtained.

The composition of the material for the rare earth magnet used in the present invention is not limited to that described above. The present invention is broadly applicable to any types of rare earth alloy powder having a low oxygen concentration that have the risk of heat generation/ignition due to oxidation in the atmosphere.

A second embodiment of the present invention will be described. As described in the first embodiment, an R—Fe—B rare earth magnet of which the oxygen content has been reduced to enhance the performance can exhibit an increased residual flux density Br while maintaining a high coercive force. In the first embodiment, however, the magnet properties may deteriorate (in particular, the coercive force may decrease) and a sufficient density may not be secured depending on the sintering conditions. This problem is serious when the content of the rare earth elements in the magnet is small, for example 32 wt. % or less, particlarly 31 wt. % or less. To conduct mass-production of the rare earth magnet, the rare earth element concentration in the magnet is preferably 29 wt. or more in view of remanence Br and coercive force $H_{cJ}$, the rare earth element concentration is more preferably in the range of 29.5 wt. % to 31 wt. %. Therefore the above problem should be resolved. The present inventors closely examined this problem, and found that the occluded hydrogen might not be released sufficiently by the heat treatment at a temperature in the range of 700° C. to less than 1000° C. (first stage of the two-stage sintering) depending on the temperature and the duration of the heat treatment. In such a case, hydrogen remains in the compact and causes variation or deterioration of the magnet properties. This is considered to occur because the compact starts shrinking from the outer portion thereof during sintering and thus hydrogen gas inside the compact finds difficulty in coming out for release.

In this embodiment, to attain a high coercive force with good reproducibility, a sufficiently large amount of hydrogen is released from the compact at the first stage of the two-stage sintering in order to control the amount of hydrogen contained in the finally-manufactured magnet to 100 wt. ppm or less. By this control, a sintered magnet with excellent magnet properties can be stably provided.

The thus-manufactured R—Fe—B rare earth magnet of this embodiment has a hydrogen content controlled to be in the range of 10 wt. ppm to 100 wt. ppm, in addition to an oxygen concentration in the range of 50 wt. ppm to 4000 wt. ppm and a nitrogen concentration in the range of 150 wt. ppm to 1500 wt. ppm. The hydrogen content is preferably as small as possible. However, if the heat treatment in the range of 700° C. to less than 1000° C. continues for a long time to release hydrogen from the compact, grain growth proceeds, though slowly. This is the reason why the lower limit of the hydrogen content is set at 10 wt. ppm. From the standpoint of attaining excellent magnetic properties, the hydrogen content is more preferably 80 wt. ppm or less.

To manufacture a magnet using powder produced by hydrogen processing for pulverization while controlling the hydrogen content of the magnet to be within the above range, attention must be paid to the conditions at the first stage of the two-stage sintering. The first-stage sintering is performed at a temperature in the range of 700° C. to less than 1000° C. If the temperature and the time of the heat treatment are combined improperly, the amount of hydrogen contained in the sintered magnet falls outside the above range. Hydrogen is released from the compact most effectively at a temperature in the range of 800° C. to 950° C. Therefore, the hydrogen release amount can be changed by retaining the temperature at 900° C., for example, and varying the retaining time appropriately. When the temperature is retained at 900° C. at the first stage, the retaining time is preferably controlled to 30 minutes or more to secure the hydrogen content of 100 wt. ppm or less.

The average crystal grain size is preferably controlled to be in the range of 3 μm to 13 μm, more preferably in the range of 3 μm to 9 μm, to attain a high coercive force.

Hereinafter, an example of the magnet of this embodiment will be described.

EXAMPLE 2

As in Example 1, a molten alloy having a composition of Nd+Pr (30.0 wt. %), Dy (1.0 wt. %), B (1.0 wt. %), and Fe (the balance) was produced in a high-frequency melting crucible. The molten alloy was then cooled with a roll-type strip caster to produce thin plate-shaped cast pieces (flake-like alloy) having a thickness of about 0.5 mm. The concentration of oxygen contained in the flake-like alloy was 150 wt. ppm.

The flake-like alloy accommodated in a case was then placed in a hydrogen furnace. After evacuation of the furnace, hydrogen gas was supplied into the furnace for two hours for hydrogen embrittlement. The hydrogen partial pressure in the furnace was set at 200 kPa. After the flakes spontaneously disintegrated due to hydrogen occlusion, the furnace was evacuated while heating for dehydrogenation. Argon gas was then introduced into the furnace, and the furnace was cooled to room temperature. The alloy was taken out from the hydrogen furnace when the temperature of the alloy was lowered to 20° C. At this stage, the oxygen content of the alloy was 1000 wt. ppm.

The resultant alloy was milled with a jet mill having a milling chamber filled with a nitrogen gas atmosphere of which the oxygen concentration was controlled to 200 wt. ppm or less, to produce magnet powder having an average particle size (milled particle size) in the range of 3.5 μm to 5.5 μm. During the milling, also, the oxygen amount contained in the nitrogen atmosphere was controlled so that the oxygen content of the powder was in the range of 2200 to 2300 wt. ppm. The resultant powder had a nitrogen concentration in the range of 200 to 400 wt. ppm.

Thereafter, 0.5 wt. % of a liquid lubricant was added to the milled powder with a rocking mixer. As the lubricant, one containing methyl caproate as a major ingredient was used. The powder was then compacted by die pressing method in an aligning magnetic field of 0.8 MA/m, to produce a compact. The size of the compact was 30 mm×50 mm×30 mm and the density was 4.2 to 4.4 g/cm$^3$.

As in Example 1, the compact was then impregnated with an oil agent from the surfaces thereof. Thereafter, the compact was subjected to two-hour preheating at 250° C. for oil removal, and then sintered under the conditions shown in Table 3 below.

TABLE 3

| Sample No. | 5 | 6 | 7 | 8 | 9 |
|---|---|---|---|---|---|
| Milled particle size (μm) | 3.5–5.5 | 3.5–5.5 | 3.5–5.5 | 3.5–5.5 | 5.5–7.5 |
| Sintering conditions | 900° C. 3 hrs. + 1050° C. 4 hrs. | 900° C. 1 hr. + 1050° C. 4 hrs. | 900° C. 5 hrs. + 1050° C. 6 hrs. | 1050° C. 4 hrs. | 1070° C. 4 hrs. |
| Crystal grain size (μm) | 8–10 | 8–10 | 10–13 | 7–9 | 14–18 |

Sintering under the conditions shown in Table 3 was performed for each sample in a decompressed Ar gas atmosphere of about 2.5 kPa. The peak temperature at which a rare earth hydrogen compound releases hydrogen is in the range of 800° C. to 900° C. The samples of sintered magnets manufactured under the above conditions were measured for the oxygen amount, the nitrogen amount, the hydrogen amount, the sintering density, and the magnetic properties, and the results are shown in Table 4 below.

TABLE 4

| Sample No. | 5 | 6 | 7 | 8 | 9 |
|---|---|---|---|---|---|
| Oxygen amount (wt. ppm) | 2500 | 2500 | 2600 | 2700 | 2600 |
| Nitrogen amount (wt. ppm) | 280 | 290 | 290 | 280 | 280 |
| Hydrogen amount (wt. ppm) | 40 | 85 | 100 | 120 | 115 |
| Sintered body density (g/cm$^3$) | 7.55 | 7.55 | 7.50 | 7.44 | 7.45 |
| Coercive force iHc (kA/m) | 1200 | 1120 | 1010 | 820 | 740 |

As is found from Table 4, while the hydrogen amount was controlled to fall within the range of 10 to 100 wt. ppm in samples 5 to 7, it exceeded 100 wt. ppm in the other samples. To set the hydrogen amount in the range of 10 to 100 wt. ppm, good coercive force can be obtained. To increase coercive force of the magnet, it is preferably that the hydrogen amount in the magnet is set to be 85 wt. ppm or less. In samples 8 and 9, where the sintering was performed only at 1050° C. or more, omitting the stage of retaining the compact at a temperature in the range of 800° C. to 900° C., it is considered that part of hydrogen contained in the surface portion of the compact was released from the compact in the course of temperature rise.

Thus, in this embodiment, a rare earth hydrogen compound ($RH_x$) contained in the grain boundary phase can be sufficiently dehydrogenated prior to start of the second-stage sintering (prior to change of the grain boundary phase into the liquid phase). This improves the sintering density and provides excellent magnet properties. The resultant magnet according to the present invention has a low hydrogen concentration compared with the conventional magnet.

In the above embodiments, dry pressing was adopted. Alternatively, wet pressing as disclosed in U.S. Pat. No. 5,489,343 may be adopted. Since the effect of the present invention obtained by reducing the hydrogen concentration is provided irrespective of the type of the pressing method, the magnetic properties also improve. In addition, in the case of adopting wet pressing to produce a compact, the process of impregnating the compact with an oil agent after the pressing may be omitted.

Thus, according to the present invention, the sintering process is performed in two stages of using a relatively low temperature and using a relatively high temperature. By this two-stage sintering process, crystal grains are suppressed from becoming coarse, and the hydrogen content is reduced. As a result, the effect of increasing the coercive force by reducing the oxygen concentration can be exhibited satisfactorily. In addition, according to the present invention, since the compact is impregnated with an oil agent from the surface thereof, oxidation of the powder compact is suppressed while the oxygen content of the magnet powder is reduced. Therefore, the risk of heat generation/ignition can be reduced, and this makes it possible to safely and practically increase the amount of the major phase of the magnet. As a result, the magnet properties of the rare earth-magnet are greatly improved.

Moreover, according to the present invention, the surfaces of the material powder particles are properly nitrided. Therefore, the surfaces of the powder particles are prevented from oxidation although the oxygen content of the magnet powder is small. As a result, the amount of the major phase of the magnet increases, and thus the magnet properties are improved.

Although nitrogen is used as an inert gas for milling process in the above embodiments argon and/or helium can be used instead of nitrogen or in addition to nitrogen for milling process.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

What is claimed is:

1. A method for manufacturing an R—Fe—B rare earth magnet, comprising the steps of:

preparing a rare earth alloy powder having an oxygen content in a range of 50 wt. ppm to 4000 wt. ppm and a nitrogen content in a range of 150 wt. ppm to 1500 wt. ppm and embrittling an R—Fe—B rare earth alloy by hydrogen occlusion and milling the embrittled alloy;

compacting the rare earth alloy powder by dry pressing to produce a compact; and, sintering the compact, wherein the step of sintering the compact includes:

a first step of retaining the compact at a temperature in a range of 700° C. to less than 1000° C. for a period of time in a range of 10 minutes to 420 minutes and releasing hydrogen outside the compact so that the amount of hydrogen contained in sintered magnet is in a range of 10 wt. ppm to 100 wt. ppm; and a second step of permitting the proceeding of sintering at a temperature in a range of 1000° C. to 1200° C., and the average crystal grain size of the rare earth magnet after the sintering is in a range of 3 μm to 9 μm.

2. A method for manufacturing an R—Fe—B rare earth magnet according to claim 1, further comprising a step of impregnating the compact with an oil agent from the surface of the compact, alter the step of compacting the rare earth alloy powder.

3. A method for manufacturing an R—Fe—B rare earth magnet according to claim 1, wherein the step of preparing rare earth alloy powder includes milling an alloy material in a nitrogen gas atmosphere having an oxygen concentration of 5000 wt. ppm or less and nitriding the surface of milled powder.

4. A method for manufacturing an R—Fe—B rare earth magnet according to claim 1, wherein the average particle size of the rare earth alloy powder is in a range of 1.5 μm to 5.5 μm.

5. A method for manufacturing an R—Fe—B rare earth magnet according claim 2, wherein the oil agent includes a volatile component.

6. A method for manufacturing an Re—Fe—B rare earth magnet according to claim 5, wherein after the step of impregnating the compact, the temperature of the compact is at least temporarily reduced due to the volatilization of the oil agent.

7. A method for manufacturing an R—Fe—B rare earth magnet according to claim 2, wherein the oil agent comprises a hydrocarbon solvent.

8. A method for manufacturing an R—Fe—B rare earth magnet according to claim 1, wherein prior to the step of compacting the rare earth alloy powder, a lubricant is added to the rare earth alloy powder.

9. A method for manufacturing an R—Fe—B rare earth magnet according to claim 2, further comprising the step of removing the oil agent substantially prior to the step of sintering the compact and alter the step of removing the oil agent, the compact is kept away from contact with the atmosphere until completion of the step of sintering the compact.

* * * * *